United States Patent [19]

Bolton, Sr.

[11] Patent Number: 4,606,461

[45] Date of Patent: Aug. 19, 1986

[54] COLLAPSIBLE CONTAINER

[75] Inventor: Stanley S. Bolton, Sr., Monroe, Mich.

[73] Assignee: Ace Paper Products Co., Monroe, Mich.

[21] Appl. No.: 724,525

[22] Filed: Apr. 18, 1985

[51] Int. Cl.[4] ..... B65D 19/00

[52] U.S. Cl. ..... 206/600; 229/41 B

[58] Field of Search ..... 206/386, 340, 600; 229/6 R, 23 R, 41 B; 108/53.1, 53.3, 53.5

[56] References Cited

U.S. PATENT DOCUMENTS

| | | | |
|---|---|---|---|
| 3,291,364 | 12/1966 | Fischer | 206/600 |
| 4,085,847 | 4/1978 | Jacalone | 206/600 |
| 4,373,637 | 2/1983 | Shippell | 206/600 |
| 4,445,614 | 5/1984 | Mitsumori et al. | 206/600 |
| 4,454,946 | 6/1984 | Yokowo | 206/600 |

*Primary Examiner*—Joseph Man-Fu Moy
*Attorney, Agent, or Firm*—Hauke and Patalidis

[57] ABSTRACT

A collapsible container made of a four-sided enclosure having two opposite panels foldable at their center and foldable relative to the two other opposite panels such that the enclosure may be collapsed by folding inwardly the two foldable panels. One unfoldable panel is hingedly attached to a tray in which the bottom of the erected enclosure is disposed and the collapsed enclosure is capable of laying flat in the tray after pivoting around the hinged structure attaching the non-foldable panel to the tray. A lid or cap is also provided for capping the enclosure when in an erected configuration ready to be filled with articles and for covering the tray containing the collapsed container enclosure. Preferably, the tray is mounted on the top of a pallet.

20 Claims, 13 Drawing Figures

COLLAPSIBLE CONTAINER

BACKGROUND OF THE INVENTION

The present invention relates to collapsible containers in general and more particularly to a reusable collapsible container attached to a pallet.

Collapsible containers, generally made of corrugated paperboard and often attached to the top of a pallet, are used, for example, for storing parts in a manufacturing plant and for transporting parts from one plant to another, or for containing goods for transportation in bulk from one location to another. The containers are sometimes disposable but, preferably, they are reusable and, for the purpose of facilitating storage and transportation of empty containers, they are made such as to be collapsible under a relatively small volume.

An example of a collapsible pallet-mounted container is disclosed in U.S. Pat. No. 4,373,637 and consists of a pallet base to which is attached a collapsible container having four wall panels, two opposite wall panels being scored such as to be foldable, and a bottom panel having a central portion attached to the pallet top and two outer panels attached at their edge to the non-foldable side panels and connected to the portion attached to the pallet top along fold score lines. By folding the scored foldable side panels inwardly and tilting the non-foldable side panels along one of the score lines of the bottom panel, the container may be collapsed above the pallet in a flattened configuration for storage.

One inconvenience of such a structure, which is common to collapsible containers mounted on a pallet, is that some portions of the collapsed container projects beyond the periphery of the pallet and the collapsed container is susceptible to becoming damaged while being transported in a collapsed configuration, or while being stored, a plurality of pallets with collapsed containers attached to each pallet being normally stored superimposed on top of each other in order to save space.

Another problem connected with collapsible containers is that the containers, when erected, may tend to spring back to a configuration intermediary between the flattened configuration and the fully erected configuration, at least until the container is partially filled.

SUMMARY OF THE INVENTION

The present invention provides collapsible containers made of appropriate flexible or foldable material, preferably corrugated paperboard, which may be used independently of being attached to a pallet or, in the alternative and preferably, attached to a pallet, and which, when collapsed, are fully protected against damages, occupy little space, can be stored either in an erected configuration or in a collapsed configuration by being placed one on the top of another, are capable of being held erected without tendency to collapse on its own, are of simple construction and are substantially strong and sturdy.

The many objects and advantages of the present invention will become apparent to those skilled in the art when the following description of an example of structure according to the best mode contemplated, at the present for practicing the invention, is read in conjunction with the accompanying drawing wherein like numerals refer to like or equivalent elements, and in which:

DETAILED DESCRIPTION OF THE PREFERRED EMBODIMENTS

Figure 1:
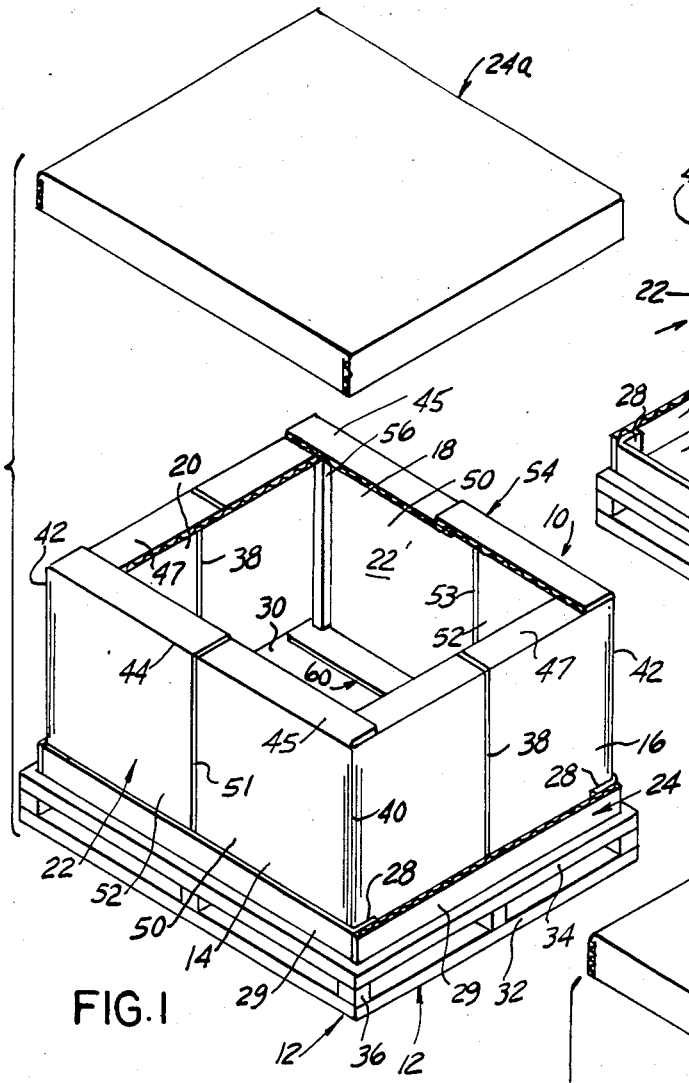
FIG. 1 is a schematic perspective view of a pallet mounted container according to the present invention shown in an erected configuration.

Referring to the drawing and more particularly to FIG. 1, an example of structure for a collapsible container 10 according to the present invention is illustrated mounted on a pallet 12. The collapsible container 10 comprises four side wall panels 14, 16, 18 and 20 forming a box-like enclosure or tube 22 inserted at its bottom in a tray 24. The tube 22 and the bottom tray 24 are made of relatively rigid cardboard sheets, such as corrugated paper or fiber boards, of any of the kinds conventionally used for manufacturing packaging boxes and containers.

Figure 12:
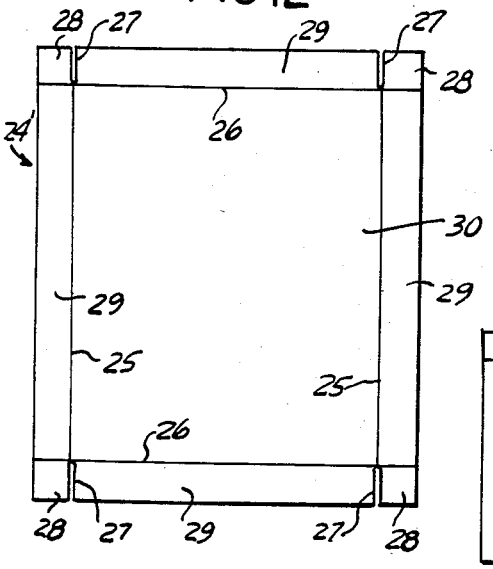
FIGS. 12 and 13 are schematic illustrations of paperboard blanks for making the container of the invention.

The tray 24 is made of a sheet or blank 24', FIG. 12, of such material provided with fold score lines formed at a predetermined distance from the edge of the blank, parallel to the edge. Two parallel score lines 25 are disposed each parallel to one of opposite edges of the blank 24', and two parallel score lines 26 are formed parallel to each other and each parallel to one of the remaining two opposite edges of the blank, at the same predetermined distance from the edges. The two ends of each of the score lines 25, for example, are slit, as shown at 27 beyond their intersection with the score lines 26, such as to form four corner flaps 28. The marginal portions of the blank 24' form four panels 29 when folded substantially at right angle to the remaining of the blank 24' which thus define the bottom 30 of the tray 24, and the flaps 28 are folded such as to be disposed behind each of a pair of opposite side panels 29, FIGS. 1-5 and glued thereto or, preferably stitched in position by any convenient means such as staples, not shown. If so desired, the collapsible container 10 may be provided with a top tray **24*a*, or lid, FIGS. 1 and 2, made in the same manner as the bottom tray 24 by way of an identical blank 24'**.

Preferably the bottom tray 24 is fastened to the top of the pallet 12, for example by means of staples, not shown, attaching the bottom panel 30 of the bottom tray 24 to the top of the pallet 12 which, as is well known in the art, is generally made of two parallely disposed wooden planks 32 and 34 separated by appropriate spacer blocks 36, such that the pallet may be transported from a location to another location by way of a fork truck.

Figure 13:
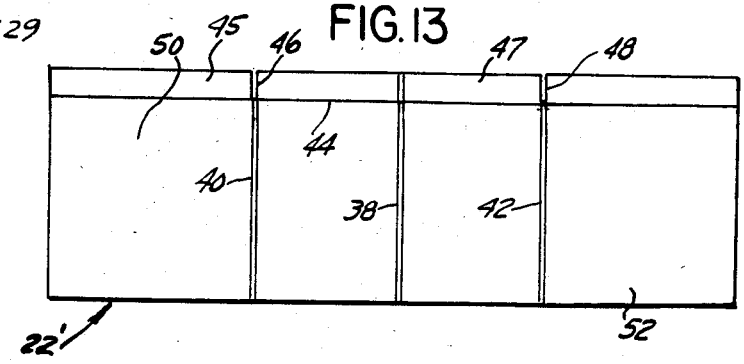

The container walls 14–20, defining the container tube 22 (FIGS. 1–3), can be of a single blank or, preferably, can be made of two identical blanks 22', FIG. 13. Each blank 22' consists of a length of corrugated board material provided with appropriate fold score lines, each formed of a single line or of two or three fold score lines closely juxtaposed and running parallel to each other, such as to provide folds with a radius rather than folds at a sharp angle. One fold score line is formed transversely to the blank 22', substantially at mid-distance from its ends as shown at 38. At equal distance from the substantially central score line 38 two additional score lines are formed, as shown at 40 and 42. A further score line 44 is formed proximate and parallel to a longitudinal edge of the blank 22', and each of the transverse score lines 40 and 42 ends in a slit or slot 46 and 48, respectively, running each to the edge of the blank 22' from the intersection of the score lines 40 and 42 with the score line 44. Two scored and slotted blanks 22' are joined together end to end for forming the substantially rectangular enclosure or tube 22, FIGS. 1–3, by folding the end portions 50 and 52 of the blank 22' substantially at right angle to the rest of the blank 22' about the score lines 40 and 42, and overlapping the edge of the end panel 50 of one blank 22' with the edge of the end panel 52 of the other blank 22'. The result is the structure illustrated at FIGS. 1–3 forming the tube 22 provided with opposite side panels 14 and 18 and opposite end panels 16 and 20, the fold about the score lines 40 and 42 of each blank defining the corners of the tube 22. The overlapped portions 51 and 53 of the end panels 50 and 52 are joined by any convenient means such as gluing, or stable or thread stitching. Preferably, and as shown at FIG. 1, the portions of the blanks 22' between the marginal score line 44 and the edge of the blanks are folded over inwardly, the slits or slots 46 and 48 (FIG. 13) allowing such folding over, so as to form a peripheral flange 54 providing additional rigidity to the tube 22 when placed over the bottom tray 24. Each corner to the tube 22 may be reinforced, such as to provide vertical rigidity to the end panels 16 and 20 and the lateral panels 14 and 18 by way of rigid elongated and rigid structural members or stiffeners 56, made of wood, plastic or rectangular cardboard tube, which are glued or stapled at each corner, for example against the internal surface of the longitudinal panels 14 and 18.

The tube 22 may simply be inserted on the top of the bottom tray 24 within the side wall panels 29 thereof or, preferably, it is attached to the bottom panel 30 of the bottom tray 24, as will be explained hereinafter, in such manner as to allow the tube 22, when collapsed, to fold into the bottom tray 24.

In the erected configuration of FIG. 1, the container 10 is ready for filling of its interior with appropriate contents to be contained therein and transported from one location to another. After filling of the container 10, it may be capped with the lid **24*a* which, if so desired, may be attached on the top of the tube 22** by gluing or by staple stitching, or simply held in position by means of straps, not shown.

Figure 2:
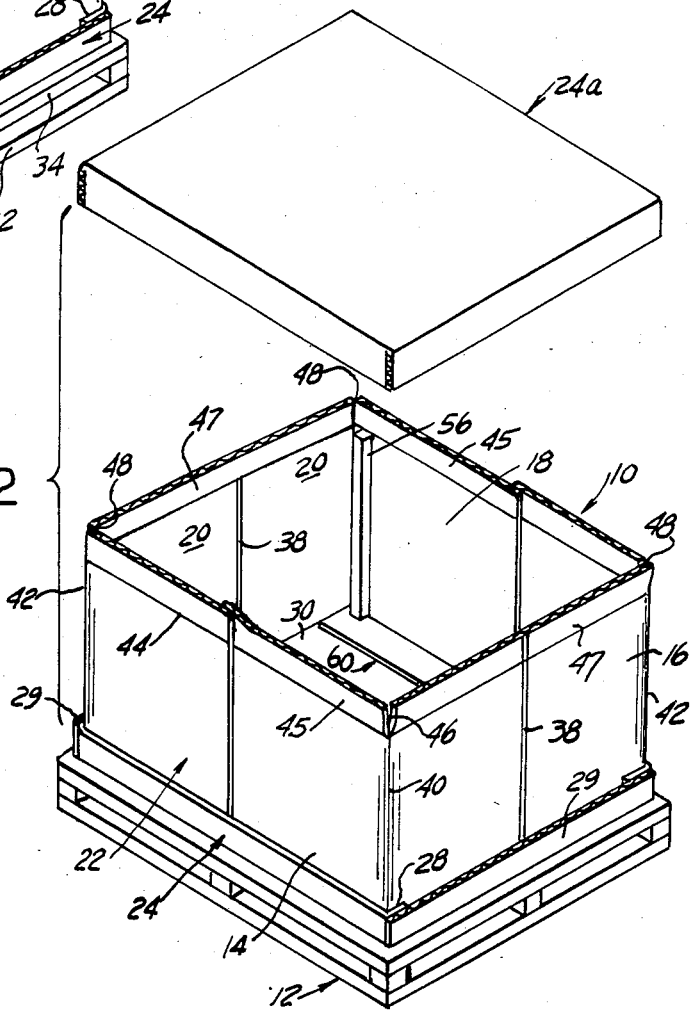
FIG. 2 is a view identical to FIG. 1 but showing the container of the invention in a usable erected configuration providing additional volume for loading the contents, or preparatory to folding.

In the configuration of FIG. 2, the container 10 is also in an erected configuration enabling filling of the interior, although the foldable end panels 16 and 20 are not held rigidly by the top flap 47 having been bent over to form a portion of the flange 54 (FIG. 1). The configuration of FIG. 2 is also illustrative of the configuration preparatory to folding of the tube 22.

Figure 7:
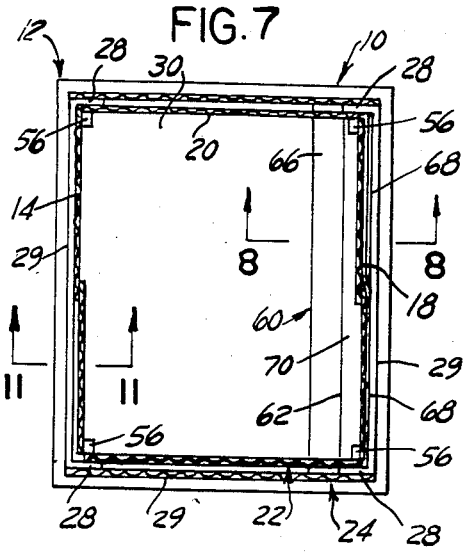
FIG. 7 is a plan view of the container in its fully erected configuration, as seen from the top of FIG. 2.
Figure 8:
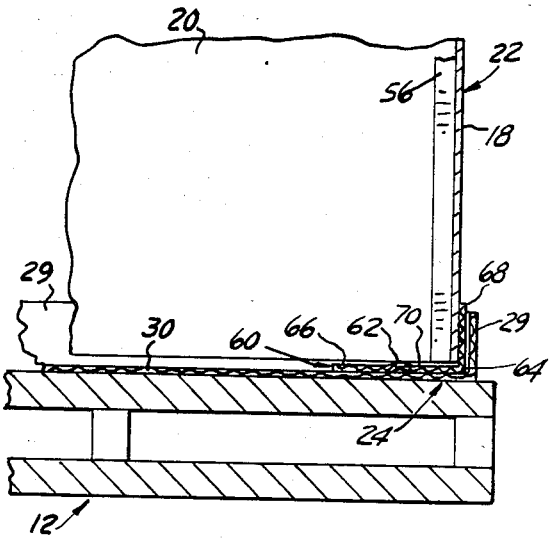
FIG. 8 is a partial section along line 8—8 of FIG. 7, viewed in the direction of the arrows.

As shown more clearly at FIGS. 7–8, one of the longitudinal panels 14 or 18 of the tube 22 is hingedly attached to the bottom panel 30 of the tray 24 by a U-sheet 60. The U-sheet 60 consists of a relatively narrow band of corrugated board material, for example, provided with two longitudinally extending parallel fold score lines 62 and 64. The portion 66 of the U-sheet 60 between the score line 62 and an edge of the sheet is attached to the bottom panel 30 of the bottom tray 24 and, in structures where the tray 24 is attached to the top of the pallet 32, is also attached to the top of the pallet by any convenient means such as stapling or nailing. The portion 68 of the U-sheet between the score line 64 and the other edge of the sheet is attached to the bottom of one of the tube longitudinal panels, for example to the bottom of the tube longitudinal panel 18, as best shown at FIG. 8, by any convenient means such as gluing, staple stitching, or thread stitching. The intermediate portion 70 of the U-sheet 60 between the lateral portion 66 attached to the bottom panel 30 of the bottom tray 24 and the other lateral portion 68 attached to the tube longitudinal panel 18, between the score lines 62 and 64, is free to fold about the score line 62.

Figure 3:
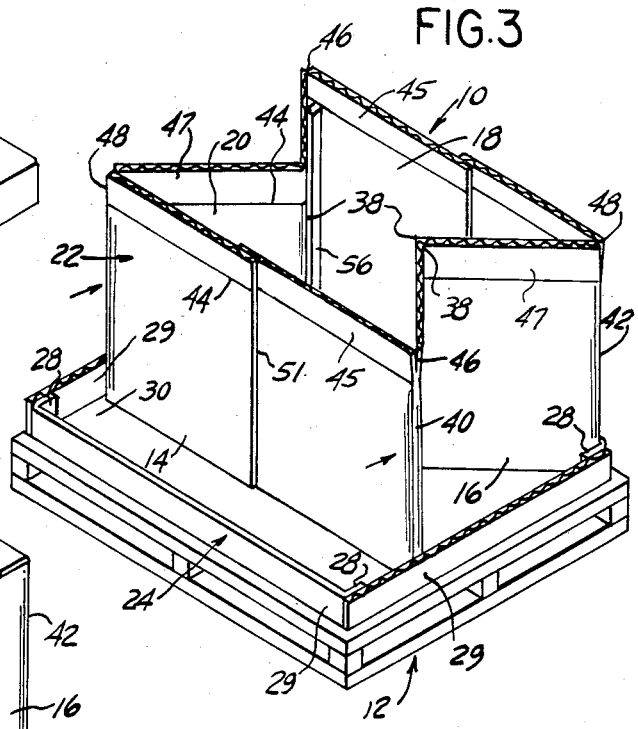
FIG. 3 is a view similar to FIG. 2, but showing the container in an intermediary folding configuration prior to being fully collapsed.
Figure 4:
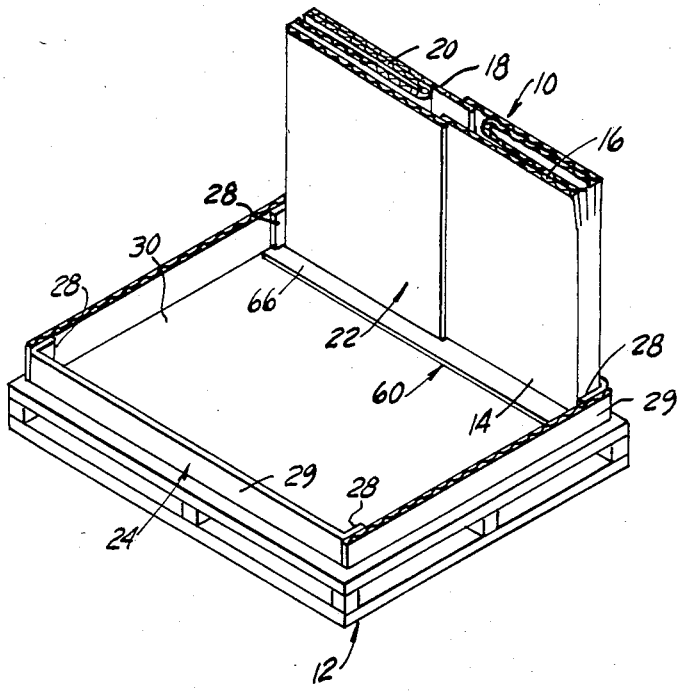
FIGS. 4 and 5 illustrate subsequent configurations of the collapsible container of the invention in the process of being collapsed and flattened.
Figure 9:
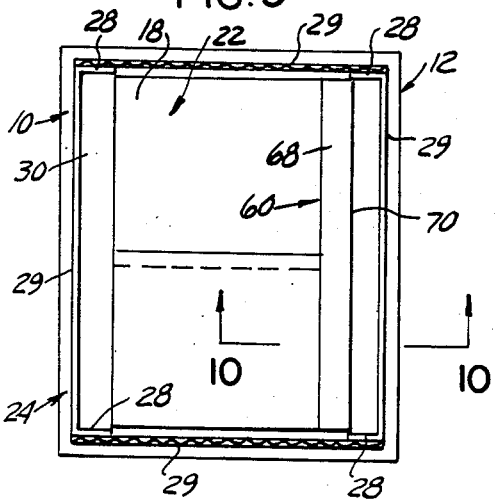
FIG. 9 is a plan view of the folded collapsed container, as seen from the top of FIG. 5.
Figure 10:
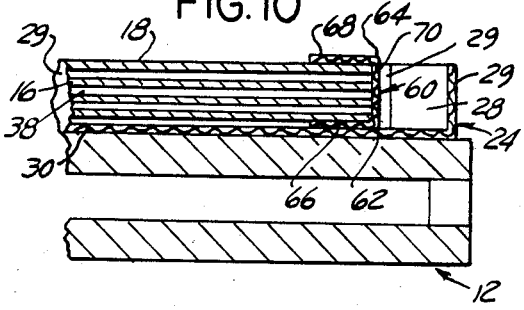
FIG. 10 is a partial section along line 10—10 of FIG. 9, as viewed in the direction of the arrows.

When it is desired to fold and collapse the container 10, from the configuration illustrated at FIG. 1, the panel end flaps 45 and 47 forming portions of the flange 54 are unfolded, as shown at FIG. 2, thus enabling the tube end panels 16 and 20 to fold inwardly about the central score line 38, or billow score line 38, as shown at FIG. 3 illustrating an intermediary configuration during collapse of the tube 22. FIG. 4 illustrates the configuration resulting from fully collapsing the tube 22, with the longitudinal panels 14 and 18 disposed relatively proximate to each other, with the folded end panels 16 and 20 disposed between the longitudinal panels 14 and 16. In structures wherein stiffeners 56 are provided at each corner of the tube 22, the resulting relatively flat package of the folded tube 22 consists of the superimposed thickness of the stiffeners 56, the relatively thin lateral panels 14 and 18 and the folded relatively thin end panels 16 and 20, whose total thickness nevertheless is arranged to be less than the depth of the tray 24, once the collapsed tube 14 is folded over around the U-sheet 60 such as to lay flat within the bottom tray 24, FIGS. 5 and 9–10. In such folded and flattened configuration, as can be seen from the illustration of FIG. 10, the central portion 70 of the U-sheet 60 is folded about the score line 62, such that the U-sheet 60 has taken a U-shape form from its substantially L-shape form of FIG. 8, with its marginal portions 66 and 68 disposed substantially in parallel planes, and its central portion 70 joining the two portions 66 and 68 disposed across the bottom edges of the collapsed tube superimposed side panels 14 and 18 and folded end panels 16 and 20.

Once the tube 22 is fully collapsed and folded around the U-sheet 60 into the bottom tray 24, the lid or cap **24*a* is preferably placed over the bottom tray such as to cover the collapsed tube 22 and protect it. The cover or cap 24*a* may be held in position by removable straps, and it will be immediately apparent that a plurality of collapsed containers, in the configuration of FIG. 6**, may be stacked on top of each other without causing any damage to the structure.

Figure 5:
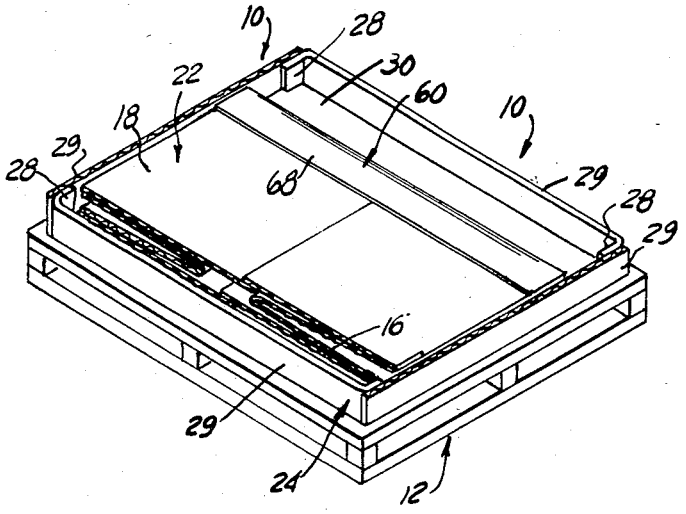
Figure 6:
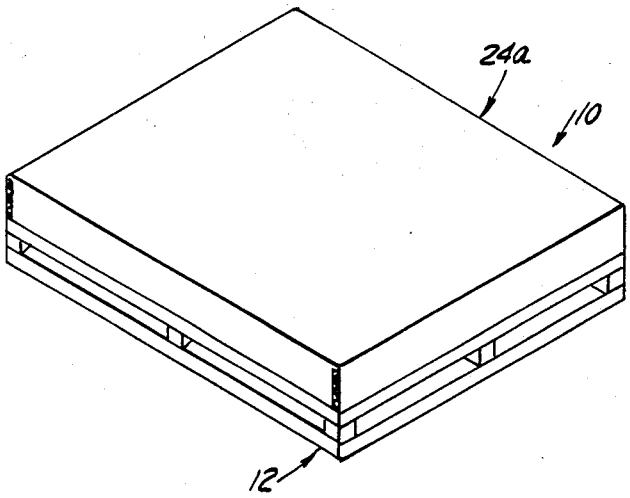
FIG. 6 is a view similar to FIG. 5 and showing the container in a collapsed configuration and protected by a lid, ready for storage or return.
Figure 11:
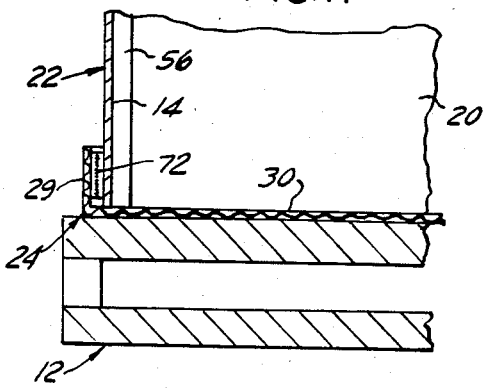
FIG. 11 is a partial section along line 11—11 of FIG. 7 illustrating a structural modification.

It will be further appreciated by those skilled in the art that the containers 10 according to the present invention are generally supplied to a user in the collapsed, flattened and covered configuration of FIG. 6 and that the container may easily be erected to the ready to fill configuration of FIG. 1 or FIG. 2 by reversing the steps illustrated at FIG. 5, FIG. 4 and FIG. 3. Once erected in the configuration of FIG. 1 or FIG. 2, and filled with articles to be stored or to be transported in the container, the container 10 remains in such erected configuration as the contents tend to spread apart the walls of the tube 22, thus applying the bottom of the panels 14, 16 and 20 firmly against the internal surface of the tray wall panels 29. Once the container 10 is filled and the lid or cap 24*a* is placed in position over the top of the tube 22, and straps are wrapped around the container being passed underneath between the platforms 36 and 34 of the pallet 32, a secure package is provided for storage or for transportation. Even without strapping the filled container, there is generally no risk that the tube 22 could be tipped over on one side, pivoting around the U-sheet 60, and spill its contents, in view of the friction between the peripheral surface of the tube 22 at its bottom and the internal surface of the tray wall panel 29. The tray wall panels 29 may be made high enough for interfering with the possible tilting of the loaded tube 22. For transportation within a plant from a location to another location, without strapping the filled container, means can be provided to prevent the tube 22 from tilting relative to the tray 24 such as, for example, attaching a band of complementary hook and loop self-attaching material 72, FIG. 11, to the exterior surface of the bottom of the lateral panel 14, and attaching a band of corresponding complementary hook and loop material 72 to the interior surface of the corresponding tray side wall panel 29, such material being available on the market under the trademark VELCRO, for example. The side panel 14 is thus firmly attached to the tray corresponding side panel 29 when the tube 22 is erected and filled with articles and, when it is desired to collapse and flatten the tube 22 within the tray 24, the side panel 14 may be easily detached from the corresponding tray panel 29.

Having thus disclosed the invention by way of an example of structure well designed to accomplish the objects of the invention, modification whereof will be apparent to those skilled in the art, what is claimed as new is as follows:

1. A collapsible container comprising an enclosure made of four interconnected wall panels of cardboard-like material, two opposite ones of said wall panels being unscored wall panels and the two remaining opposite ones of said wall panels being scored with a billow score line disposed substantially at the center of each of said two remaining opposite wall panels parallel to each corner formed between each of said two remaining opposite wall panels and the two opposite ones of said unscored wall panels, a tray having a bottom panel and four side panels of predetermined height, said tray being so dimensioned that said enclosure may be placed in said tray, a scored sheet of pliable material having a pair of longitudinally disposed spaced apart score lines extending from one end to another end of said sheet each a predetermined distance from and parallel to an edge of said sheet, said score lines defining a first marginal portion, a central portion and a second marginal portion each foldable relative to an adjoining portion, means permanently attaching one of said marginal portions to the bottom of one of the opposite unscored wall panels of said enclosure, means permanently attaching the other of said lateral portions to the bottom panel of said tray proximate a side panel thereof, wherein each billow score line allows each of the scored wall panels to be inwardly foldable between the unscored wall panels for collapsing said enclosure to a predetermined thickness, and said scored sheet enables the resulting collapsed enclosure to pivot about the longitudinally disposed score line between the marginal portion of said scored sheet permanently attached to the bottom panel of said tray and said central portion of said scored sheet for folding said collapsed enclosure within said tray and to pivot about the longitudinally disposed score line between the marginal portion of said scored sheet permanently attached to the bottom of said one of the unscored wall panels and said central portion of said scored sheet, said central portion having a width larger than the thickness of the collapsed enclosure and narrower than the height of the side panels of said tray

2. The collapsible container of claim 1 further comprising a score line running parallel to the top edge of said enclosure, and a slit at each corner of said enclosure from said score line to the edge of said enclosure, said score line permitting to fold a marginal portion of said enclosure between said score line and the top edge of said enclosure for forming a reinforcing flange bent inwardly.

3. The collapsible container of claim 1 further comprising an elongate substantially rigid stiffening member attached at each corner of said enclosure.

4. The collapsible container of claim 2 further comprising an elongate substantially rigid stiffening member attached at each corner of said enclosure.

5. The collapsible container of claim 1 further comprising means removably attaching at least the bottom of the other of said opposite unscored wall panels of said enclosure to said tray.

6. The collapsible container of claim 2 further comprising means removably attaching at least the bottom of the other of said opposite unscored wall panels of said enclosure to said tray.

7. The collapsible container of claim 3 further comprising means removably attaching at least the bottom of the other of said unscored wall panels of said enclosure to said tray.

8. The collapsible container of claim 4 further comprising means removably attaching at least the bottom of the other of said opposite unscored wall panels of said enclosure to said tray.

9. The collapsible container of claim 1 further comprising a lid removably attachable over the top of said enclosure.

10. The collapsible container of claim 2 further comprising a lid removably attachable over the top of said enclosure.

11. The collapsible container of claim 5 further comprising a lid removably attachable over the top of said enclosure.

12. The collapsible container of claim 6 further comprising a lid removably attachable over the top of said enclosure.

13. The collapsible container of claim 1 further comprising a pallet disposed below said tray attached to said tray.

14. The collapsible container of claim 2 further comprising a pallet disposed below said tray attached to said tray.

15. The collapsible container of claim 5 further comprising a pallet disposed below said tray attached to said tray.

16. The collapsible container of claim 6 further comprising a pallet disposed below said tray attached to said tray.

17. The collapsible container of claim 7 further comprising a pallet disposed below said tray attached to said tray.

18. The collapsible container of claim 8 further comprising a pallet disposed below said tray attached to said tray.

19. The collapsible container of claim 9 further comprising a pallet disposed below said tray attached to said tray.

20. The collapsible container of claim 10 further comprising a pallet disposed below said tray attached to said tray.

* * * * *

UNITED STATES PATENT AND TRADEMARK OFFICE

CERTIFICATE OF CORRECTION

PATENT NO. : 4,606,461

DATED : August 19, 1986

INVENTOR(S) : Stanley S. Bolton, Sr.

It is certified that error appears in the above-identified patent and that said Letters Patent is hereby corrected as shown below:

Col. 6, line 51, after "said" (first occurrence) add --opposite--

Signed and Sealed this

Twenty-fifth Day of November, 1986

*Attest:*

DONALD J. QUIGG

*Attesting Officer* *Commissioner of Patents and Trademarks*